US006926180B2

(12) United States Patent
Mainetti

(10) Patent No.: US 6,926,180 B2
(45) Date of Patent: Aug. 9, 2005

(54) ROD FOR A CLOTHES HANGER AND HANGER

(75) Inventor: Mario Mainetti, Valdagno (IT)

(73) Assignee: Mainetti Technologies, S.p.A., Castelgomberto (IT)

( * ) Notice: Subject to any disclaimer, the term of this patent is extended or adjusted under 35 U.S.C. 154(b) by 0 days.

(21) Appl. No.: 10/339,751

(22) Filed: Jan. 9, 2003

(65) Prior Publication Data

US 2003/0136806 A1 Jul. 24, 2003

(30) Foreign Application Priority Data

Jan. 18, 2002 (IT) ..... VI2002A0009

(51) Int. Cl.[7] ..... A41D 27/22
(52) U.S. Cl. ..... 223/85
(58) Field of Search ..... 223/85

(56) References Cited

U.S. PATENT DOCUMENTS 2,277,995 A 3/1942 Schmitt
2,344,172 A 3/1944 Ruen et al.
2,447,132 A * 8/1948 Meyer ..... 223/85
3,157,324 A 11/1964 Barnes
3,782,612 A * 1/1974 Barnes et al. ..... 223/85
4,026,446 A 5/1977 Kessler
5,040,707 A 8/1991 Ayano et al.
5,078,307 A * 1/1992 Suddath ..... 223/92
5,526,968 A * 6/1996 Larson ..... 223/88
5,839,629 A * 11/1998 Zuckerman ..... 223/85
6,213,359 B1 4/2001 Gish

* cited by examiner

*Primary Examiner*—John J. Calvert
*Assistant Examiner*—James G Smith
(74) *Attorney, Agent, or Firm*—Francis C. Hand; Carella, Byrne, Bain et al

(57) ABSTRACT

The rod for a clothes hanger is characterized in being formed from an elongated body consisting of two different mutually co-extruded materials. The first material forms a core that has the function of ensuring the structural rigidity of the rod and the second material forms a cover, arranged externally, that has the function of forming an anti-slip friction contact with the hung item of clothing.

16 Claims, 3 Drawing Sheets

ROD FOR A CLOTHES HANGER AND HANGER

This invention relates to a rod for a clothes hanger. More particularly, this invention relates to a clothes hanger having a rod.

As is well known, clothes hangers are usually produced with an arch-shaped rigid structure that is intended to support shouldered items and an underlying rod for intended to support folded items of clothing. Generally, the rod is referred to as a trouser rod.

One drawback connected with the use of conventional trouser rods is that they do not offer sufficient friction to prevent the slipping and consequent falling of the hung item.

In order to overcome such a drawback, in some cases, the surface of the trouser bar has been covered with an anti-slip chemical product and a fabric material so as to increase the friction between the rod and the hung item. Other techniques have also been suggested, such as in U.S. Pat. No. 4,026,446, which describes an iron clothes hanger the horizontal part of which is equipped with an enclosing closed cover suitable for locking the hung item of clothing; U.S. Pat. No. 5,078,307, in which the surface which produces the friction is realized through sprayed velvet particles, or else through strands wound into an interknit braid applied on an adhesive coating which covers the rod; and U.S. Pat. No. 6,126,049 which describes covering the rod with a spongy plastic structure, such as polyurethane foam.

The systems known up to now have, however, proved unsatisfactory due to the high realization cost or because they are ineffective following vibrations which are created during the transport of the hung items of clothing from place to place.

Accordingly, it is an object of the invention to provide a trouser rod which not only has an effective non-slip surface but also is simple to manufacture.

It is another object of the invention to provide a trouser rod having a non-slip surface is more cost-effective and stronger, with the same section, than similar products.

It is another object of the invention to provide a trouser rod that can be assembled into a complete hanger in a simple fast manner.

It is another object of the invention to be able to readily assemble a series of trouser rods and hanger bodies into complete hangers.

Briefly, the invention provides a rod for a clothes hanger that is comprised of an elongated core of a structurally rigid material and a cover externally on and along the core, the cover being of an anti-slip material for friction contact with an item of clothing hung thereon. In accordance with the invention the core and the cover are co-extruded to form a unitary elongated body.

The core, arranged internally, has the function of ensuring the structural rigidity of the rod and the cover, arranged externally, has the function of forming an anti-slip friction contact with the hung item of clothing.

In a preferred embodiment, the elongated body is substantially cylindrical and the cover extends coaxially for a more or less on a substantial length of the core.

Still in a preferred embodiment, the core includes a plurality of longitudinal ribs, such as radial fins, that may also be enclosed in a reinforcement rim.

Still in a preferred embodiment, the core is made of a thermolastic material and, specifically, of polystyrene and the cover is made of a plastic material, such as, thermoplastic rubber.

The trouser rod can be incorporated into an arch-shaped rigid structure for supporting clothing by suitable means that allow for quick assembly. For example, the means may be in the form of pins or bushes which are slotted at the ends of the rod and mounted on protruding hooks of the arch shaped structure.

These and other objects of the invention will become more apparent from the following detailed description taken in conjunction with the accompanying drawings wherein.

Figure 1:
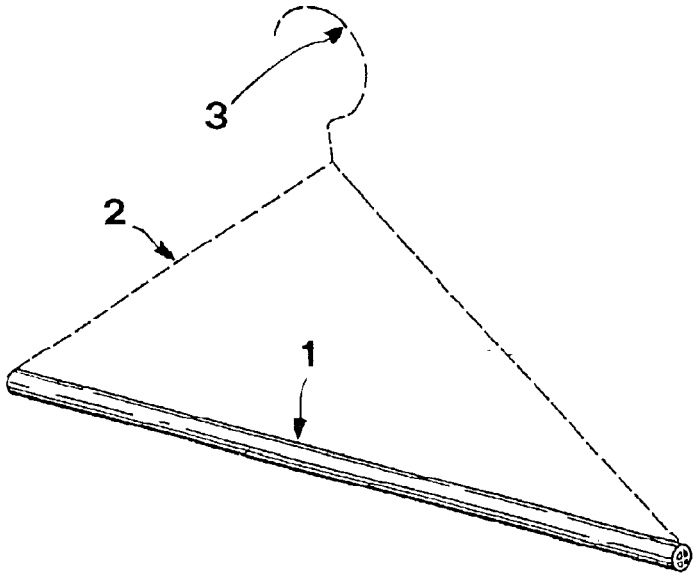
FIG. 1 illustrates a perspective view of a rod according to the invention mounted on a rigid arch-shaped structure to form a hanger.

Referring to FIG. 1, the trouser rod 1 is secured to an arch-shaped rigid structure equipped with a central hook 3 to form a hanger 2.

Figure 2:
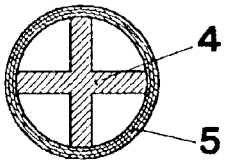
FIG. 2 illustrates a cross-sectional view of a rod having a core formed of four radially disposed ribs in accordance with the invention.

The rod 1 is a substantially cylindrical elongated body made through the co-extrusion of a first material that forms a core 4 and a second material that forms a cover 5, as shown in FIG. 2. The material of the core 4 is chosen to ensure the structural rigidity of the rod 1 whereas the material of the cover 5 is chosen to provide the rod 1 with the appropriate anti-slip properties so that a hung item of clothing folded over the rod itself generates an anti-motion friction effect.

Figure 3:
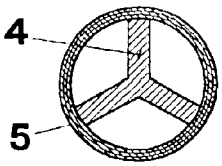
FIG. 3 illustrates a cross-sectional view of a rod having a core formed of three radially disposed ribs in accordance with the invention.
Figure 4:
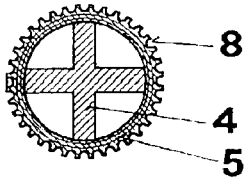
FIG. 4 illustrates a cross-sectional view of a rod having a cover formed with external protrusions to increase the friction between a hung item and the rod in accordance with the invention.
Figure 5:
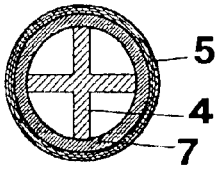
FIG. 5 illustrates a cross-sectional view of a rod similar to FIG. 2 with a reinforcement rim encompassing the core in accordance with the invention.
Figure 6:
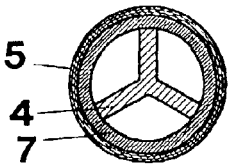
FIG. 6 illustrates a cross-sectional view of a rod similar to FIG. 3 with a reinforcement rim encompassing the core in accordance with the invention.
Figure 7:
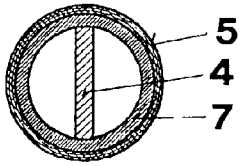
FIG. 7 illustrates a cross-sectional view of a rod having a core formed of a single rib, a reinforcement rim and a cover in accordance with the invention.

In the preferred embodiment, the core 4 has a circular section configured from an appropriate number of cross ribs or radial fins. For example, the core 4 may be formed of four longitudinal radially disposed ribs, as shown in FIGS. 2, 4 and 5, or three such ribs, as shown in FIGS. 3 and 6, or a single rib, as shown in FIG. 7. In some embodiments, as shown in FIG. 4, the cover 5 may have protrusions 8 to increase the frictional characteristics of the cover.

Further, as shown in FIGS. 5, 6 and 7, a reinforcement rim 7 of the same material as the core 4 may encompass the ribs of the core 4 within the cover 5. This rim 7, besides increasing the rigidity of the core 4, also constitutes a support surface in addition to the cover 5.

Figure 8:
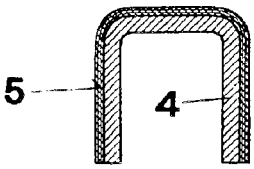
FIG. 8 illustrates a cross-sectional view of a rod having a U-shaped cross-sectional shape in accordance with the invention.

The core 4 and cover 5 can have co-extruded configurations which are not limited to a circular configuration but can consist of other shapes, including open shapes, suitable for the purpose such as, for example, triangular, square, hexagonal and the like. For example, the rod may be made with a U-shaped cross-section wherein each of the core 4 and cover 5 are U-shaped as shown in FIG. 8.

Figure 9:
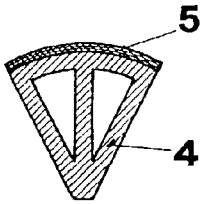
FIG. 9 illustrates a cross-sectional view of a rod having a V-shaped cross-sectional shape in accordance with the invention.

Also, the rod may of be V-shaped cross-section wherein each of the core 4 is V-shaped, as shown in FIG. 9, with a single longitudinal rib employed in the core 4 and the cover 5 covers only one peripheral side of the core 4.

Figure 10:
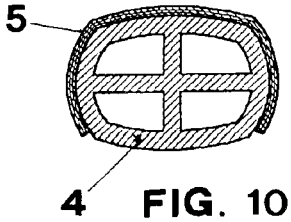
FIG. 10 illustrates a cross-sectional view of a rod having a rounded rectangular shaped cross-section in accordance with the invention.

Also, the rod may of be of rounded rectangular shape in cross-section wherein the core 4 is closed and includes four longitudinal crossing ribs and the cover 5 is of U-shape to partially cover the periphery of the core 4, as shown in FIG. 10.

The outer peripheral surface of the cover 5 can be shaped as any suitable polygonal shape.

Constructively, the material of the core 4 is a suitable thermoplastic or styrene material and the material of the cover 5 is a plastic material. In greater detail, the material of the core 4 preferably consists of polystyrene, whereas the material of the cover 5 preferably consists of a thermoplastic rubber, a generic term which includes different types of rubbers, such as resins, each of which is suitable for the purpose.

Other materials suitable for the purpose can be chosen to realize the materials for the core and cover, in relation to the specific applications, as is possible for a man skilled in the art.

Although the preferred version of the invention consists of a trouser rod 1 which comprises a cylindrical elongated body with a cross-shaped section, it must be understood that in the context of the present invention expressions such as "cylindrical", "cross" and "circular" and all other relative equivalents and/or variants thereof, must not be taken in the restrictive sense to limit the filed of application of the invention, since other customized versions of the rod could be used according to the invention, as is clear to a man skilled in the art.

Figure 11:
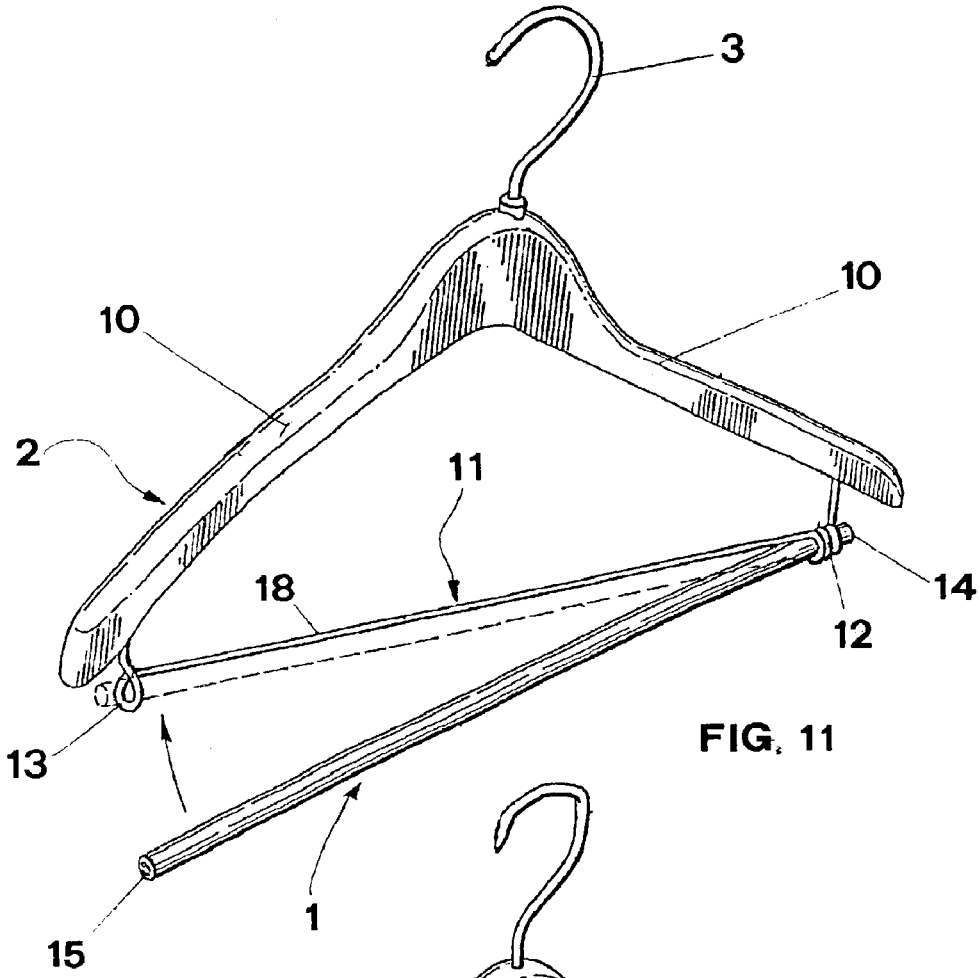
FIG. 11 illustrates a view of a hanger with a rod according to the invention.

Referring to FIG. 11, wherein like reference characters indicate like parts as above, the hanger 2 includes a rigid arch-shaped structure having shoulders 10 which extend outwards in opposite directions from a central hook 3 and a cross rod 1. In addition, the hanger 2 has hooking means for securing the rod 1 to the opposite ends of the arch-shaped structure. This hooking means consists of a filiform element 11 equipped with curved portions 12 and 13 to be used for hooking the rod 1 and having ends anchored to the shoulders 10. The first curved portion 12 is wound around the first end 14 of the rod 1 and the second curved portion 13 is removably hooked onto the second end 15 of the rod 1.

Figure 12:
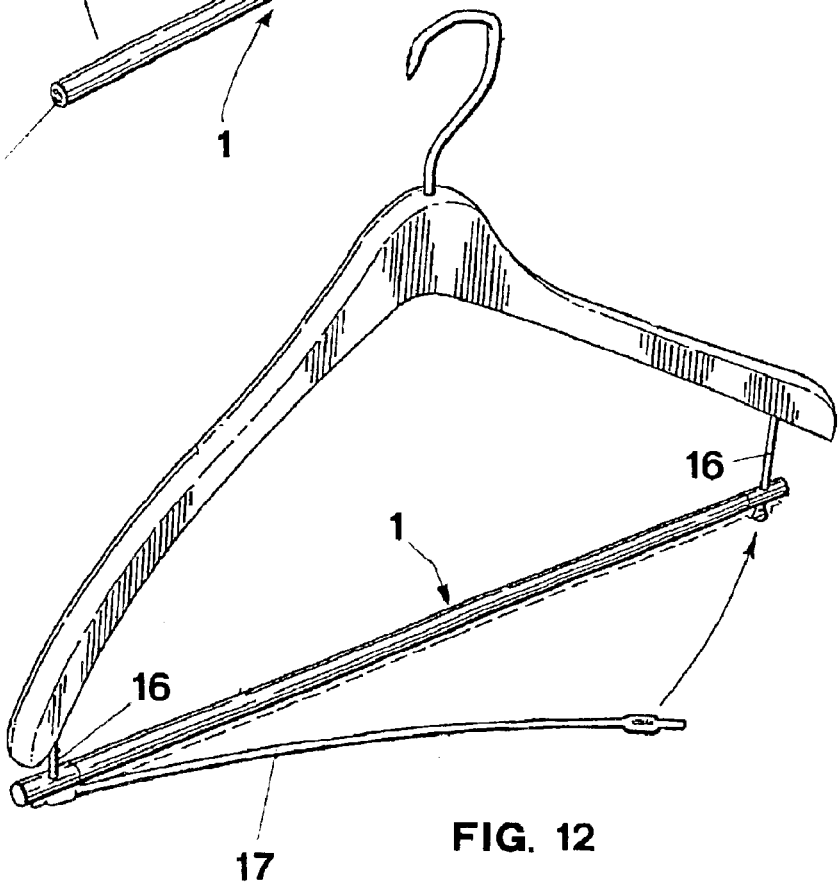
FIG. 12 illustrates a view of a modified hanger with a rod according to the invention.

Referring to FIG. 12, wherein like reference characters indicate like parts as above, the hooking means may comprise a pair of pins 16 fixed, on one side, to the shoulders 10 and, on the other side, to the two ends 14 and 15 of the rod 1.

To increase the friction cooperation between the rod 1 and a hung item of clothing, an elastic strip 17 (see FIG. 12) is used, or else the central part 18 of the filiform element 11 (see FIG. 11) is exploited as a pant trap. Such accessories are per se known in the state of the art.

Figure 13:
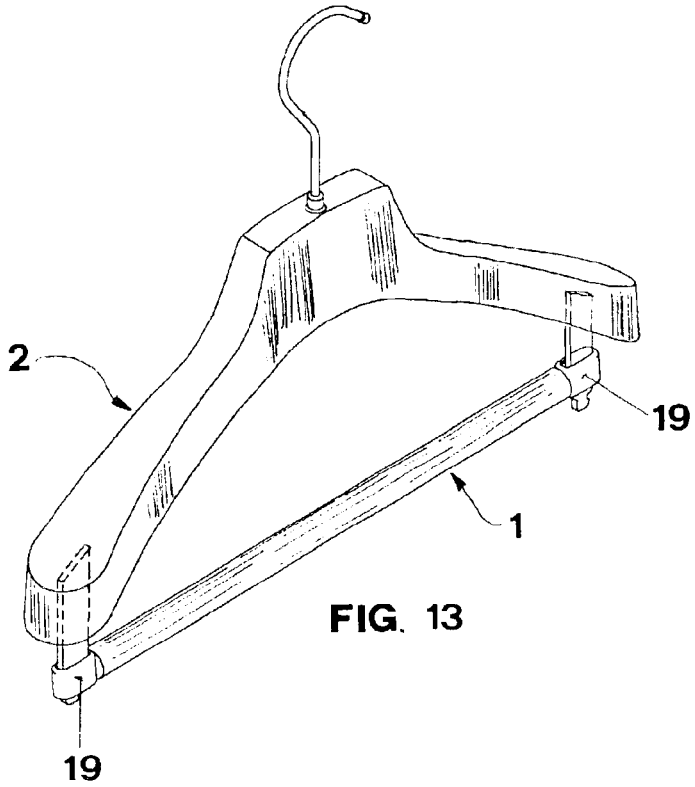
FIG. 13 illustrates a view of a further modified hanger with a rod according to the invention.
Figure 14:
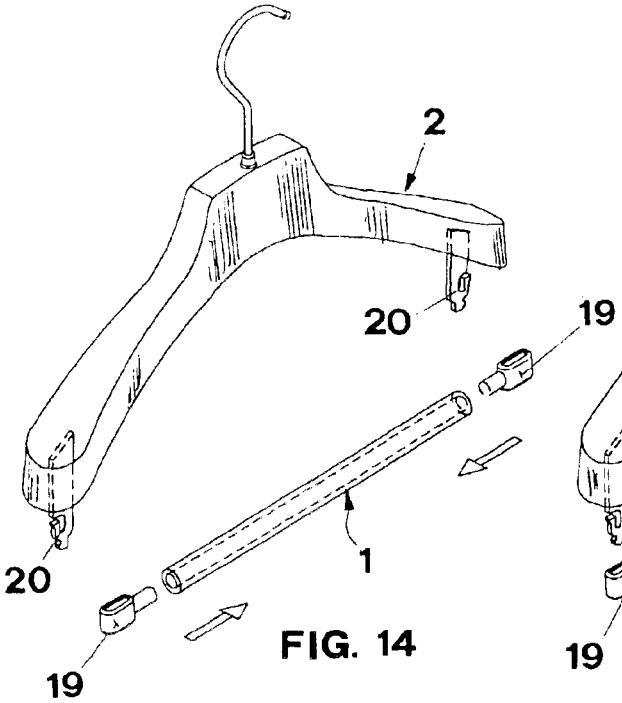
FIG. 14 illustrates an exploded view of the hanger of FIG. 13.
Figure 15:
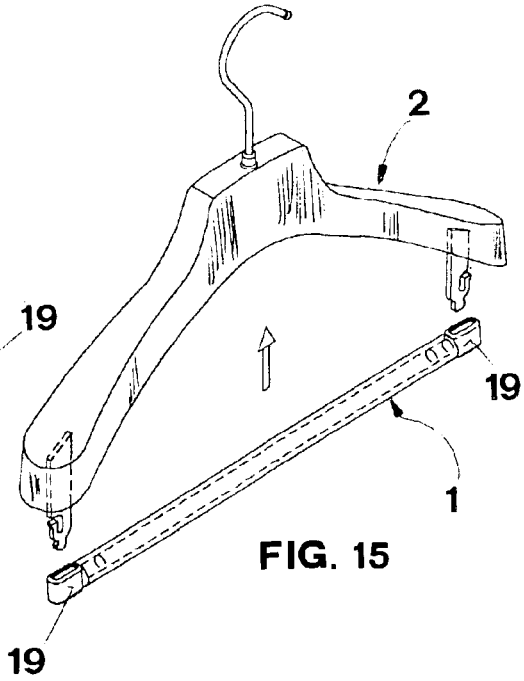
FIG. 15 illustrates the hanger of FIG. 13 at one step in the assembly of the hanger.

Referring to FIG. 13, wherein like reference characters indicate like parts as above, the hooking means for securing the rod 1 to the hanger 2 includes bushes 19 and hooks 20. The bushes 19 are of the same shape as the rod 1 and are firstly slotted onto the ends of the rod 1 forming a single piece, as indicated in FIGS. 14 and 15. The bushes 19 are then attached to the hooks 20 which protrude from the shoulders 10 to complete the hanger, as indicated in FIGS. 15 and 13.

The elements of the hooking means, such as the filiform element 11, pins 16, bushes 19 and elastic strip 17, are removable with respect to the body of the hanger 2, and can function as accessories to be used in connection or not with the hanger.

Other types of hooking means may also be used.

The invention thus provides an anti-slip rod 1 in a single finished piece. For this reason, an assembly operation with other anti-slip elements or specific procedures for creating the friction effect are not required, as they are in previously known procedures.

Another advantage of the invention derives from the use of co-extrusion, which is a simpler and more cost-effective procedure with respect to the co-injection procedure, used up to now.

Another advantage of the invention, is the elimination of the so-called sleeve, which, slotted and possibly stuck to the rod, with the passing of time always tends to move and, therefore, causes the falling of a hung item of clothing.

What is claimed is:

1. A rod for a clothes hanger comprising an elongated core of a structurally rigid material; and a cover externally on and along said core, said cover being of an anti-slip material for friction contact with an item of clothing hung thereon and wherein said core and said cover form a two layer unitary elongated body.

2. A rod as set forth in claim 1 wherein said elongated body has a substantially cylindrical cross-section and said cover extends along at least a substantial length of said core.

3. A rod as set forth in claim 1 wherein said core includes a plurality of longitudinal ribs.

4. A rod as set forth in claim 3 wherein said ribs are radially disposed.

5. A rod as set forth in claim 4 further comprising a reinforcement rim encompassing said radially disposed ribs within said cover.

6. A rod as set forth in claim 4 wherein said core is made of a thermoplastic material.

7. A rod as set forth in claim 6 wherein said thermoplastic material is a styrene material.

8. A rod as set forth in claim 4 wherein said core is made of polyester.

9. A rod as set forth in claim 1 wherein said cover is a plastic material.

10. A rod as set forth in claim 9 wherein said cover is made of thermoplastic rubber.

11. A rod as set forth in claim 1 wherein said elongated body has a cylindrical shape, said core includes a plurality of radially directed longitudinal ribs and is made of polyester and said cover is made of thermoplastic rubber.

12. A clothes hanger comprising an arch-shaped rigid structure for supporting shouldered clothing and having a centrally disposed hook; and an underlying trouser rod for supporting folded items of clothing, said rod being connected to opposite ends of said arch-shaped structure, said rod including an elongated core of a structurally rigid material and a cover externally on and along said core, said cover being of an anti-slip material for friction contact with an item of clothing hung thereon and wherein said core and said cover are co-extruded to form a two layer unitary elongated body.

13. A hanger as set forth in claim 12 further comprising means for securing said rod to said opposite ends of said arch-shaped structure.

14. A hanger as set forth in claim 12 wherein said means includes a filiform element having a first curved portion wound around a first end of said rod and a second curved portion removably attached onto a second end of said rod.

15. A hanger as set forth in claim 12 wherein said means comprises a pair of pins fixed on one side to said arch-shaped structure and on an opposite side to two ends of said rod.

16. A hanger as set forth in claim 12 wherein said means comprises of a pair of bushes, each said bush being slidably mounted in a respective end of said rod, and a pair of hooks, each said hook protruding from a respective end of said arch-shaped structure and being secured to a respective bushing.

* * * * *